US005383624A

United States Patent [19]

Simon

[11] Patent Number: 5,383,624

[45] Date of Patent: Jan. 24, 1995

[54] PORTABLE HOSE REEL

[76] Inventor: Jerry M. Simon, 1415 S. Harbor Dr., Merritt Island, Fla. 32952

[21] Appl. No.: 930,314

[22] Filed: Aug. 14, 1992

[51] Int. Cl.[6] ..... B65H 75/40

[52] U.S. Cl. ..... 242/396.1; 242/404.1

[58] Field of Search ..... 242/86.4, 94, 99, 96, 242/107.6, 84.8, 86.7, 396.1, 404.1, 129.6, 129.62

[56] References Cited

U.S. PATENT DOCUMENTS

| | | | |
|---|---|---|---|
| 483,390 | 9/1892 | Reynolds | 242/86 |
| 1,340,712 | 5/1920 | Hare | 242/84.8 |
| 2,717,129 | 9/1955 | McDonald | 242/99 |
| 2,733,024 | 1/1956 | Eden | 242/86 |
| 3,330,498 | 7/1967 | Rucky | 242/86.4 |
| 3,625,450 | 12/1971 | Lloyd, Jr. | 242/86 |
| 3,979,833 | 9/1976 | Grundman | 242/84.8 X |
| 4,200,983 | 5/1980 | West et al. | 242/84.8 X |
| 4,747,561 | 5/1988 | Sweeny et al. | 242/96 |
| 4,784,221 | 11/1988 | Share et al. | 242/86.4 |
| 4,979,693 | 12/1990 | Ederhardt et al. | 242/96 |
| 5,007,598 | 4/1991 | Spear et al. | 242/86.2 |
| 5,056,553 | 10/1991 | Whiteheat et al. | 137/355.27 |

FOREIGN PATENT DOCUMENTS

| | | | |
|---|---|---|---|
| 3712500 | 12/1988 | Germany | 242/96 |

*Primary Examiner*—Daniel P. Stodola
*Assistant Examiner*—Eileen A. Dunn
*Attorney, Agent, or Firm*—James H. Beusse

[57] ABSTRACT

A portable reel assembly for collapsible fire hose includes a reel formed of a pair of circular end plates coupled by a plurality of radially spaced spokes. The reel assembly is supported within a U-shape carrying handle on an axle extending between distal ends of the handle. The spokes extend through at least one of the end plates forming a plurality of free ends. A locking rod is reciprocally mounted to the handle and positioned for interfering with the free ends of the spokes in a locking position so as to prevent rotation of the reel. In a retracted position of the lock rod, the reel is free to rotate for either collecting or deploying the fire hose.

5 Claims, 1 Drawing Sheet

PORTABLE HOSE REEL

BACKGROUND OF THE INVENTION

The present invention relates to a portable hose reel and, more particularly, to a lightweight reel assembly which may be carried by a shoulder strap for deploying collapsed fire hoses.

Hose reels are well known devices for storing hose and for allowing hose to be deployed by unwinding from the reel. Hose reels used for conventional hose are generally large assemblies mounted on a wheeled frame. Such large assemblies are not suitable for use in storing fire hoses in a form for rapid deployment. U.S. Pat. No. 4,979,693 describes a hose reel for collapsible fire hose which is uniquely designed to transport a pair of hoses and simultaneously deploy both hoses. While there may be particular instances in which both a supply and return hose are required, primary requirements for a fireman call for an easily deployed water supply hose.

SUMMARY OF THE INVENTION

It is an object of the present invention to provide a lightweight hose reel which can be carried by a shoulder strap and easily deploy a fire hose. In an exemplary embodiment, the invention comprises a portable hose reel for carrying and deploying a collapsible hose and having reel means for receiving a plurality of convolutions of the collapsible hose arranged in generally spirally wound relation thereon. The reel means includes an axle having a pair of opposite end portions and a pair of members extending generally radially about the axle and secured to the axle adjacent its opposite end portions, respectively. A plurality of means is secured between the members in radially spaced relation with the axle for supporting engagement with an inner convolution of the collapsible hose in its spirally wound relation on the reel means. At least some of the supporting engagement means have a free end extending generally axially beyond one of the members. Frame means pivotally support the opposite end portions of the axle. A resiliently urged means is mounted to the frame means for manual movement between an at-rest position and a displaced position, the resiliently urged means in its at-rest position being disposed in part between adjacent ones of the free ends for engagement therewith to obviate unreeling of the collapsible hose from the reel means. The resiliently urged means in its displaced position being displaced from the free ends thereby to permit unreeling of the collapsible hose from the reel means.

The invention further includes a latching mechanism for holding the resiliently urged means in its displaced position during unreeling of the collapsible hose. Means are also attached to the frame means for releasibly coupling a carrying strap to the hose reel for transporting the reel and hose.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
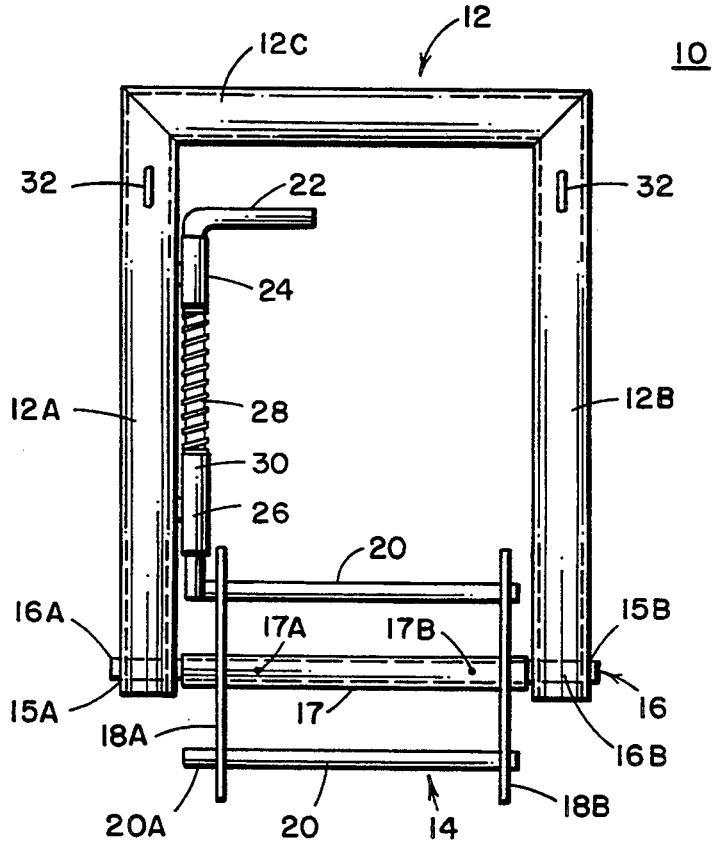
FIG. 1 is front view of the hose reel of the present invention.

FIG. 1 is a front view of a portable hose reel 10 in an exemplary form of the present invention. The reel 10 includes a frame assembly 12 having a pair of side members 12*a* and 12*b* and a top connecting handle member 12*c*. The handle assembly 12 is preferably formed as a generally U-shaped member and is constructed of one inch Sch. 40 tubing. A reel assembly 14 is rotatably connected to the distal ends of the side members 12*a* and 12*b*. The reel assembly includes an axle 16 having opposite end portions 16*a* and 16*b* which are sized to fit within apertures 15*a*,15*b* formed in the distal ends of the side members 12*a* and 12*b*. The reel assembly 14 includes a hub 17 comprising an elongated tubular member which fits round the axle 16. In the illustrative embodiment, the axle 16 may be pinned to the distal ends of the side members 12*a* and 12*b* since the hub 17 may rotate about the axle 16. The hub 17 may be provided with oil holes 17*a* and 17*b* to allow oil to be squirted into the space between the inner surface of the hub and the outer surface of the axle to facilitate rotation of the hub about the axle 16.

The reel assembly 14 further includes a pair of opposite end members 18*a* and 18*b* which define the area between which the collapsible hose may be wound on the reel assembly 14. It will be noted that the end member 18*b* is positioned nearer the side member 12*b* than the member 18*a* is positioned with respect to side member 12*a*. This positioning provides an apparent offset of the reel assembly 14 with regard to a center of the hose reel. Disposed radially outward of hub 17 and extending between the opposite end members 18*a* and 18*b* are a plurality of supporting engagement means or spokes 20 upon which the collapsible hose is wound. The spokes 20 each have a free end 20*a* which extends outwardly of the end member 18*a* of the reel assembly. As will become apparent, the free ends 20*a* of the supporting engagement means or spokes 20 is utilized to latch or lock the reel assembly in a fixed position to prevent unreeling of a collapsible hose wound on the reel assembly 14.

Unreeling of the reel assembly 14 is provided by a resiliently urged means or locking rod 22 which is mounted for reciprocal movement to the side member 12*a*. The locking rod 22 is supported within a pair of spaced guides comprising an upper guide 24 and a lower guide 26. Each of the spaced guides 24,26 may be welded or otherwise attached to the outer surface of the side member 12*a*. The locking bar 22 has an upper end extending generally parallel to handle 12*c* and has a lower end extending towards the free ends 20*a* of reel assembly 14. Between the upper and lower guides 24 and 26 there is a compression spring 28 which fits around the locking rod 22. A pinned sleeve or spring stop 30 is positioned about the locking rod 22 for reacting against the compression spring 28. One end of the compression spring 28 also reacts against the upper guide 24 to thereby urge the sleeve 30 downward towards lower guide 26 carrying the locking rod downward so that the extending end of the rod 22 enters the space between the free ends 20*a* of spokes 20. In the illustrated position, the end 22*a* interferes with the ends 20*a* of spokes 20 thereby preventing rotation of the reel assembly 14. However, if the upper end of rod 22 is pulled towards the handle 12*c*, the end will move out of the interference zone with free ends 20*a* and allow the reel assembly to rotate about axle 16.

Figure 2:
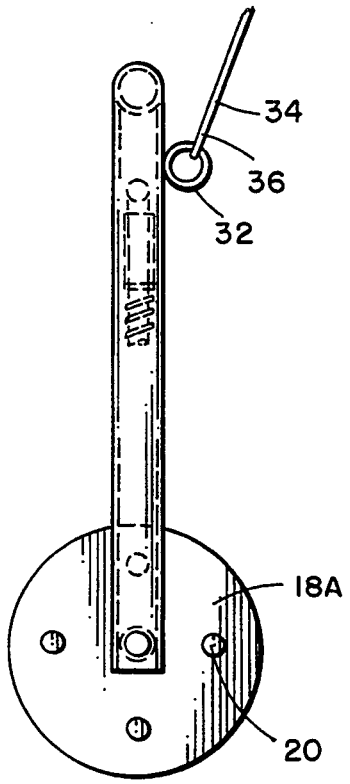
FIG. 2 is a side view of the hose reel of FIG. 1.

Considering FIG. 1 in combination with FIG. 2, it can be seen that there are provided a pair of strap rings 32 attached to the upper end of each of the side members 12*a* and 12*b*. The strap rings 32 are provided to allow attachment of a carrying strap indicated at 34 in FIG. 2. The carrying strap 34 may be a conventional nylon mesh strap having an upper broader surface for fitting over a person's shoulder and including a pair of releasable fasteners at 36 for attaching to the strap rings 32.

Figure 3:
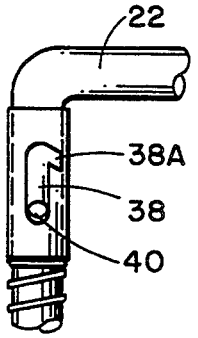
FIG. 3 is an enlarged view of the latching mechanism for the locking rod associated with the reel of FIG. 1.

Turning now to FIG. 3, there is shown an enlarged view of a mechanism utilized for latching the locking rod 22 in an unlatched position with respect to reel assembly 14. The latching mechanism comprises a slot 38 formed in the upper guide 24. The slot 38 extends generally parallel to the direction of movement of the locking rod 22 but at its upper end has an angularly oriented downward extension 38*a*. A pin 40 extends into the locking rod 22 and extends outwardly into the slot 38. As the rod 22 is lifted, the pin moves vertically up the slot until it reaches the transverse extension 38*a*. At this point, the locking rod may be rotated or twisted in a counter clockwise direction to move the pin 40 into the extension 38*a* to thereby hold the locking rod in the upward disengaged position. In this upward position, the reel assembly 14 is free to rotate about axle 16 and can be so rotated in order to reel a collapsible hose upon the reel assembly 14 or to allow a previously reeled hose to be deployed by unreeling from the reel assembly 14.

It will be noted that a collapsed fire hose may be wound on the reel assembly 14 by placing a fitting at the end of the collapsible hose between the spokes 20 and then manually turning the reel assembly to initiate coiling of the hose about the reel. If the fire hose is stretched out on the ground as it usually is, the reeling may simply require that the portable hose assembly be pushed along the ground once the end of the hose has been initially started to be wound on the reel. By pushing it along the ground, the reel will rotate and collect the laid out hose.

While the invention has been described in what is presently considered to be a preferred embodiment, various modifications will become apparent to those having ordinary skill in the art. It is intended therefore that the invention not be limited to the specific embodiment illustrated but be interpreted within the full spirit and scope of the appended claims.

What is claimed is:

1. A portable hose reel for carrying by a person and deploying a collapsible hose comprising:

reel means for receiving a plurality of convolutions of the collapsible hose arranged in generally spirally wound relation thereon, said reel means including an axle having a pair of opposite end portions, respectively, a pair of members extending generally radially about said axle and secured to said axle adjacent its opposite end portions, a plurality of means secured between said members in radially spaced relation with said axle for supporting engagement with an inner convolution of the collapsible hose in its spirally wound relation on said reel means, and at least one of said supporting engagement means respectively having a free end extending generally axially beyond one of said members;

frame means pivotally supporting said opposite end portions of said axle; and resiliently urged means mounted to said frame means for manual movement between an at-rest position and a displaced position of said resiliently urged means, said resiliently urged means in its at-rest position being disposed in part in an interfacing position with said free end to engage therewith and to obviate de-reeling of the collapsible hose from said reel means and said resiliently urged means in its displaced position being displaced from said free end thereby to permit de-reeling of the collapsible hose from said reel means.

2. The portable hose reel of claim 1 wherein each of said supporting engagement means have a free end extending generally axially beyond one of said members and said resiliently urged means in its at-rest position being disposed in part between adjacent ones of said free ends for preventing unreeling of the collapsible hose.

3. The portable hose reel of claim 2 wherein said resiliently urged means comprises a locking rod extending through an upper and a lower guide, compression spring means surrounding said rod between said guides and being fixed to said rod for urging said rod toward said reel means.

4. The portable hose reel of claim 3 and including a slot formed in said upper guide and having a first portion extending generally parallel to a direction of motion of said rod between said at-rest and said displaced positions, a second portion of said slot extending generally transverse to said first portion, and a pin affixed to said rod and extending into said slot for latching said rod in said displaced position by rotating said pin into said second portion of said slot.

5. The portable hose reel of claim 4 and including means attached to said frame means for releasably coupling a carrying strap to said reel.

* * * * *